United States Patent [19]

Zahora et al.

[11] 4,187,833

[45] Feb. 12, 1980

[54] VENTING SYSTEM FOR GAS-FIRED HEATING PLANTS

[75] Inventors: Edward P. Zahora; Edward Zahora, Jr., both of Naperville, Ill.

[73] Assignee: Kinetics, Inc., Naperville, Ill.

[21] Appl. No.: 897,586

[22] Filed: Apr. 19, 1978

[51] Int. Cl.[2] ..... F23J 11/00; F23L 3/00

[52] U.S. Cl. ..... 126/312; 98/48; 110/193; 126/297; 126/307 A; 431/20

[58] Field of Search ..... 126/307 A, 312, 296, 126/297, 293, 301; 98/48; 431/20; 110/47, 162

[56] References Cited

U.S. PATENT DOCUMENTS

| | | | |
|---|---|---|---|
| 403,672 | 5/1889 | Humphrey | 126/297 |
| 1,837,581 | 12/1931 | Peterson | 126/312 |
| 2,002,020 | 5/1935 | Nyborg | 126/312 |
| 4,009,705 | 3/1977 | Smith | 126/307 A |
| 4,079,727 | 3/1978 | Smith | 126/312 |

*Primary Examiner*—James C. Yeung
*Assistant Examiner*—Daniel J. O'Connor
*Attorney, Agent, or Firm*—Fidler, Patnaude & Batz

[57] ABSTRACT

A venting system for gas fired heating plants including a diverter box, conduit means for conducting gas from one heating plant upwardly in one leg of an inverted U pattern and downwardly into the second leg of such pattern while admitting air at the bottom of the box to form a heat lock to restrict the flow of air in this pattern, and a second conduit means for conducting gas from a second heating plant upwardly and then downwardly of the second leg of the pattern for the first heating plant to a level at which gas may be passed within the box from the inlet to the outlet of the box, thus providing a structure which avoids the blowing out of the pilot flame in one or another of the heating plants.

4 Claims, 1 Drawing Figure

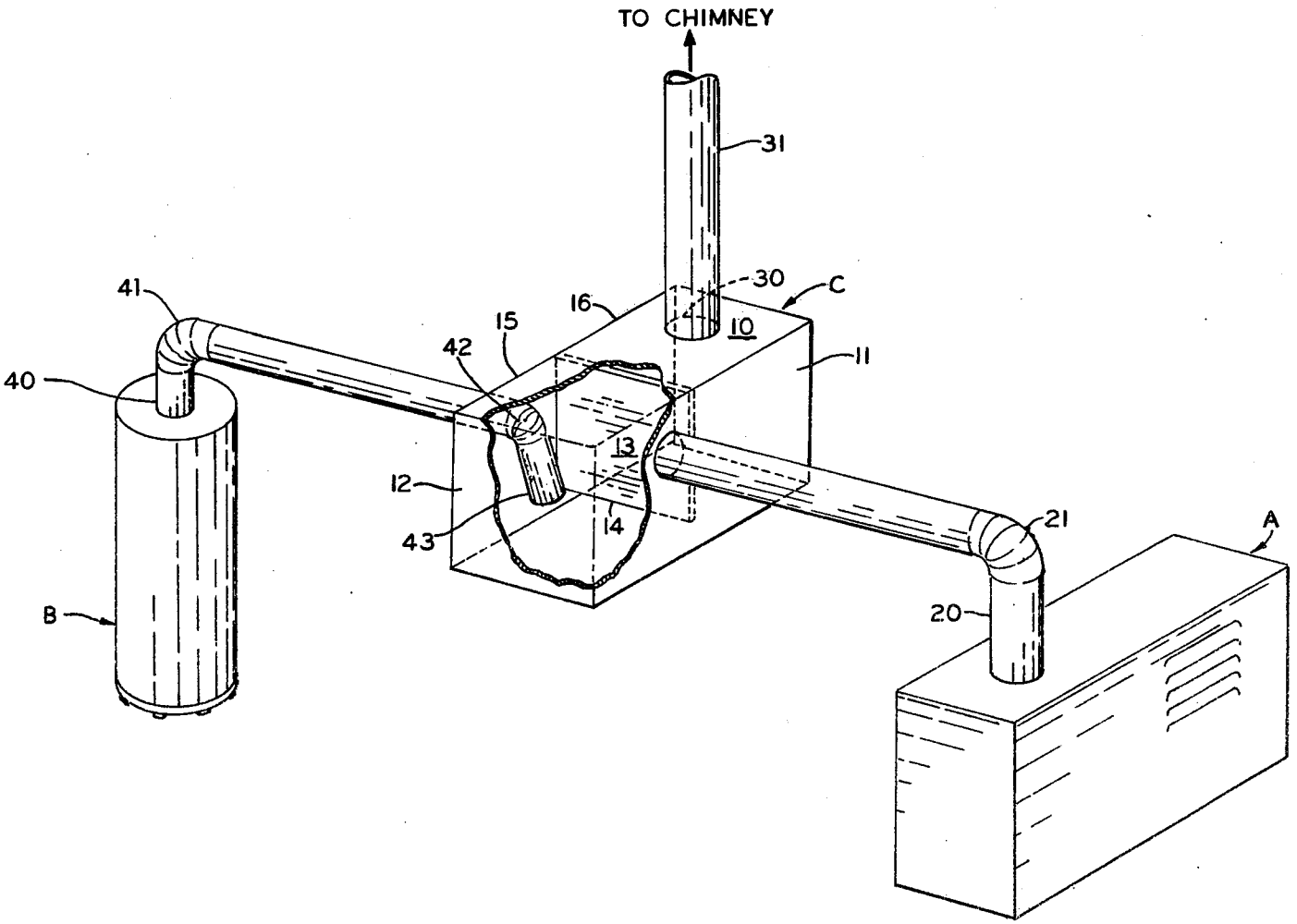
TO CHIMNEY
31
30
C
10
11
16
15
42
13
14
12
43
21
20
A
41
40
B

VENTING SYSTEM FOR GAS-FIRED HEATING PLANTS

This invention relates to a system for passing gases from the combustion chamber of heating plants to a chimney with improved efficiency, and more particularly to such a system in which gases from more than one such plant may be conducted through the system and passed to the chimney without danger of blowing out the pilot flames in either of the plants.

BACKGROUND OF THE INVENTION

Systems for improving the efficiency of heating plants have been known in which combustion gases from one plant are passed downwardly through the top of the diverter box and then upwardly through the top of the box to the chimney, the bottom of the box being open so that the pressure of the surrounding air establishes a head which provides a heat lock so as to restrict air passage downwardly into the box, thus causing more heat to be absorbed in the plant and less to be passed out to the chimney.

Such a system is described in U.S. Pat. No. 4,009,705. A difficulty which has been experienced in the use of such known systems of this type is that, as a practical matter, their use has been limited to but a single heating plant. When more than one heating plant is connected to the diverter box of systems heretofore known, the inevitable result has been to blow out the pilot flame in one or another of the plants. This result has rendered impractical the use of such prior devices for handling gases from more than one plant.

This disadvantage affects the economic value of the diverter device where, as is common, two heating units, such as a furnace and a water heater, must be served.

Accordingly, it is an important object of the present invention to provide a system in which more than one heating unit may be served using a single diverter box but without unwanted consequences such as a blowing out of the pilot in any one of the multiple plants being served.

SUMMARY

We have discovered that by enclosing the gas from a second plant in a conduit which extends downwardly of a leg of the heat lock of the first plant and extends to the level where the gas from the first plant is permitted to pass toward the outlet of the diverter box, the interaction between the two plants which has resulted in extinguishing the flame in one or another of the plants, is avoided. This improvement will be further clarified in the following detailed description and explanation in connection with one embodiment of our invention.

DETAILED DESCRIPTION OF THE DRAWING

Our invention is illustrated in the accompanying drawing in which the single FIGURE is a perspective view of the improved system in which a part of the diverter box is broken away to show the extension of the conduit which leads from the second heating plant into and downwardly within the diverter box.

As illustrated, the first heating plant A which may be a gas-fired furnace, appears on the right and the second heating plant B which may be a gas-fired water heater, appears on the left. Each of these plants has a combustion chamber containing a gas burner.

Centrally located in the drawing is the diverter box C. This box has a top 10, spaced sides 11 and ends 12. It is open at the bottom. Inside box C is a partition 13 extending between the sides 11 about midway between ends 12. The edges of the partition are sealed to the top and sides of the box. The bottom edge 14 of the partition is located above the plane of the bottom edge of the box. The purpose of this will be explained as this description proceeds. The partition 13 divides the box 10 into two end portions one of which is the inlet portion 15 which in the drawing is shown forwardly of the partition 13, and the other of which is the outlet portion 16 which in the drawing is shown rearwardly of the partition.

To give a general indication of the relative proportions of box C, we mention as a specific example a box having the dimensions of 16 inches in length, 8 inches in width, and 43 inches in depth.

In such special case, the distance between the bottom of the partition 13 and the bottom of the box may be, for example, 10 to 12 inches. With the dimensions above given, the box would provide, at the inlet portion, an internal vertical column of gas which is 8 inches in cross section and about 32 inches tall (when considering the bottom edge 14 of the partition as the bottom of the column). The outlet end portion 16 would contain similar dimensions. It is understood that these dimensions and proportions are not rigid, and when plants of greater or lesser capacity are involved, the dimensions may be increased or decreased accordingly. The proportions may also vary to a reasonable degree.

The box C may be made of sheet metal or other fire resistant material, and may be mounted on the furnace casing or in any convenient way between or adjacent to the plants A and B. In mounting box C, the bottom of the box may be at a level between about the level of the furnace burner to about 4 feet above the level of the furnace burner. Preferably the bottom of box C should be at a level which also is in this same range above the level of the burner in the water heater.

The pipe 20 has its lower end connected with the combustion chamber of plant A, and extends upwardly to the elbow 21 from which it extends, in the illustrated embodiment, substantially horizontally to the upper part of the inlet portion 15. Gas from plant A may pass through pipe 20 into the upper part of the inlet portion 15.

The pipe 20 together with the inlet portion of box C down to edge 14 of the partition 13, makes up the conduit means providing the gas circuit having the pattern of an inverted U. The gas from the furnace combustion chamber rises to the elbow 21, then to the upper part of inlet portion 15 of box C and down within portion 15 to the bottom of partition 13 where it may cross under the partition into outlet portion 16 and then out through opening 30 and pipe 31 to the chimney. This provides the inverted U pattern in which the vertical portion of pipe 20 is one leg of the conduit pattern and the walls of portion 15 of box C is the other leg of the inverted U pattern.

The pressure of air to which the gas is exposed in portion 15 provides the heat lock which restricts the flow of air through the U-shaped gas pattern above described. In operation the inlet portion 15 fills with gas depressing the inner face of flue gas and air to the level where the flue gas may spill under partition 13 while still being retained by the bottom portions of the sides and end of the box.

The conduit means which connects the second heating plant (which may be a water heater) with the diverter box C includes the pipe 40. This pipe feeds from the combustion chamber of the second plant vertically upward to elbow 41 from which it extends (substantially horizontally in this embodiment) to and through the opening 42 in the upper part of inlet portion 15 of box C. On the interior of portion 15, pipe 40 turns downwardly and extends to approximately the level of the bottom edge 14 of partition 13. In the drawing this extension is designated by the character 43. The open lower end of extension 43 then may be at about the level of the lower edge of the partition 13. The system will operate satisfactorily if the open pipe end is at the level of the bottom of the partition or an inch or more below, but can be no more than slightly above this level in order that the gas emanating from the pipe end pass under the partition instead of rising within portion 15. Preferably, the lower open end of extension 43 lies midway between sides 11 so that the gases from pipe 40 may cross under the central portion of partition 13.

The air pressure from the open bottom of box C also bears against the gas in the lower part of pipe 43 to provide a heat lock within pipe 43, particularly in extension 43, which restricts passage of air through this conduit system and so obtains greater efficiency from the second heating plant.

The relatively small cross sectional area of the pipe 43 within portion 15 as compared with the cross sectional area of this portion provides a condition such that the operation of the heat lock of the first heating plant is not substantially affected, and in addition to overcoming the tendency to blow out the pilot in one or another plant, we obtain the additional advantage of a double heat lock for increasing the efficiency of the two heating plants.

Instead of running the pipe 20 substantially horizontally into the inlet portion 15 of box C, we may run this pipe upwardly above box C and then downwardly to connect it into the top of portion 15; and in this case the heat lock due to the air pressure from the open bottom of box C extends upwardly above box C into the pipe. When this condition exists the partition 13 can be omitted if desired. This allows the gases from the pipe 20 to cross at the top of box C to outlet opening 30 where they may enter pipe 31 and go to the chimney. In such case the outlet end portion of pipe 40 may be caused to pass through the wall of pipe 20 at a point above the box C, with the extension 43 of pipe 40 extending downwardly to the level inside inlet portion 15 at which the gases may pass across the top of the box to the outlet 30. When pipe 40 is extended downwardly within the pipe 20, it is, of course, required that pipe 20 be of substantially larger cross-section than the pipe 40, so as not to affect the heat lock to the first plant. By way of example, the pipe 20 may have a diameter of 6 to 10 inches, while the pipe 40 may have a diameter of 3 inches.

There is a limit, however, as to the height to which the pipe 20 may be extended before it turns down toward the box C. We have found that extension of this pipe upwardly to a level which is more than 4 feet from the burner of the first plant produces some uncertainty of operation and when the pipe is extended to a level of much more than 5 feet above the burner of this plant, the passage of the gases through the heat lock may fail to occur. By the same principle, when the pipe 40 is extended upwardly to the same extent as above described, the gases from the second heating plant may fail to pass the heat lock.

In the foregoing presentation we have described in detail the conduit system which extends from the combustion chamber of the second heating plant B into the box C. We may also include a third or multiple other plants which may be one or more additional water heaters, each of which may be connected by conduits in the same way as water heater B, each of which delivers combustion gases within section 15 of box C at about the level of the bottom edge of the partition 13, or in the situation where partition 13 is omitted, at about the level at which gases may pass across the top of the box to the outlet 30.

While in the foregoing description and drawing only one embodiment has been illustrated and described in detail together with certain variations, it is understood that many other embodiments may be constructed and many changes and variations made all within the spirit of the invention and the scope of the appended claims.

What is claimed:

1. In combination with a first gas-fired heating plant, a second gas-fired heating plant, each of said plants having a combustion chamber and a chimney for receiving gaseous products of combustion from both said plants, the improvement comprising: a diverter box having an inlet end portion and an outlet end portion and having a partition between said portions, the bottom of said partition being above the bottom of said box to permit passage of gases from the inlet end portion to the outlet end portion while within the box, first conduit means for conducting gases from the combustion chamber of said first plant with the upper portion of said inlet end portion of said box, outlet conduit means for conducting gases from the upper portion of the outlet end portion of said box to said chimney, a second conduit means for conducting gases from the combustion chamber of said second plant to the upper portion of the inlet portion of said box and downwardly within said inlet end portion to about the level of the lower edge of said partition, the bottom of said box being open to the atmosphere surrounding said plants to thereby admit air and establish a pressure forming a heat lock to restrict the flow of air from the combustion chamber of said second plant through said first conduit means.

2. The combination set forth in claim 1 in which the bottom of said box is at the level of the gas burner in said first plant to 5 feet above the level of said first plant gas burner.

3. The combination set forth in claim 2 in which the bottom of said box is at the level of the gas burner in said first plant to 5 feet above the level of said first plant gas burner.

4. The combination set forth in claim 1 in which said conduit means has an open end which is exposed to air entering said box from the open bottom of said box to establish a heat lock to restrict the flow of air from the combustion chamber of said second plant through said second conduit means.

* * * * *